US005651419A

United States Patent [19]

Holzer et al.

[11] Patent Number: 5,651,419

[45] Date of Patent: Jul. 29, 1997

[54] POWERED HAND TOOL

[76] Inventors: Peter Holzer, Allmendstr. 6E, CH-4500 Solothurn; Hermann Schaible, Häslimattstr. 6, CH-4652 Biberist, both of Switzerland

[21] Appl. No.: 137,110

[22] PCT Filed: Feb. 9, 1993

[86] PCT No.: PCT/EP93/00317

§ 371 Date: Oct. 18, 1993

§ 102(e) Date: Oct. 18, 1993

[87] PCT Pub. No.: WO93/16845

PCT Pub. Date: Sep. 2, 1993

[30] Foreign Application Priority Data

Feb. 19, 1992 [DE] Germany ..... 42 04 947.4

[51] Int. Cl.[6] ..... B25F 5/00

[52] U.S. Cl. ..... 173/217; 310/50; 173/183

[58] Field of Search ..... 173/117, 217, 173/170, 181, 182, 183; 310/50, 71

[56] References Cited

U.S. PATENT DOCUMENTS

| | | | |
|---|---|---|---|
| 2,037,890 | 4/1936 | Dow | 173/217 |
| 4,006,784 | 2/1977 | Dudek | 173/182 |
| 4,544,039 | 10/1985 | Crane | 173/2 |
| 4,569,125 | 2/1986 | Antl et al. | 29/469 |
| 4,930,583 | 6/1990 | Fushiya et al. | 173/217 |
| 4,991,472 | 2/1991 | Hollingsworth . | |

FOREIGN PATENT DOCUMENTS

| | | |
|---|---|---|
| 0129754 | 1/1985 | European Pat. Off. . |
| 3239238 | 4/1984 | Germany . |

*Primary Examiner*—Scott A. Smith

[57] ABSTRACT

A hand-held machine tool has a housing having a wall provided with a duct, a motor arranged in the housing and having a gear unit with a spindle, a tool holder carried by the spindle, and an electric lead extending in the duct of the wall of the housing, the electric lead being fixed in the duct of the wall.

4 Claims, 1 Drawing Sheet

POWERED HAND TOOL

BACKGROUND OF THE INVENTION

The present invention relates to a powered hand tool.

More particularly, it relates to a powered hand tool which has a housing, a motor arranged in the housing and provided with a gear unit and with a spindle, a tool holder carried by the spindle and an electric lead extending in a duct of a wall of the housing.

A hand-held machine tool of the generic type in which an electric lead is arranged in cable ducts of the housing which extend in planes dividing the two shell parts of the housing is known from EP-PS 129 754. The electric lead is installed in these ducts without any special steps for securing it in position and is accordingly exposed to vibrations occurring during operation of the hand-held machine tool. There is no sure way to rule out the possibility of a break in the lead or damage to the insulation particularly when the invention is used in percussion drills or drill hammers. Further, a creepage barrier of at least 4 mm length is prescribed for electric leads in electric hand-held machine tools. Under certain circumstances, this can lead to construction-related problems in the known invention.

SUMMARY OF THE INVENTION

Accordingly, it is an object of the present invention to provide a hand-held machine tool, which avoids the disadvantages of the prior art.

In keeping with these objects and with others which will become apparent hereinafter, one feature of the present invention resides, briefly stated, in a hand-held machine tool, in which the electric lead, in particular a multi-wire flat-ribbon cable, is arranged so as to be fixed in the duct in the wall of the housing.

When the hand-held machine tool is designed in accordance with the present invention, it has the advantage over the prior art that the electric lead is arranged so as to be fixed and sealed in such a way as to prevent displacement or tearing of the lead even during heavy vibrations. Further, a creepage barrier with a minimum creepage path of 4 mm is ensured for the electric lead in the hand-held machine tool according to the invention at a normal housing wall thickness well below 4 mm. Above all, sensitive sensor cables can be installed in hand-held machine tools in a particularly reliable manner by means of the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
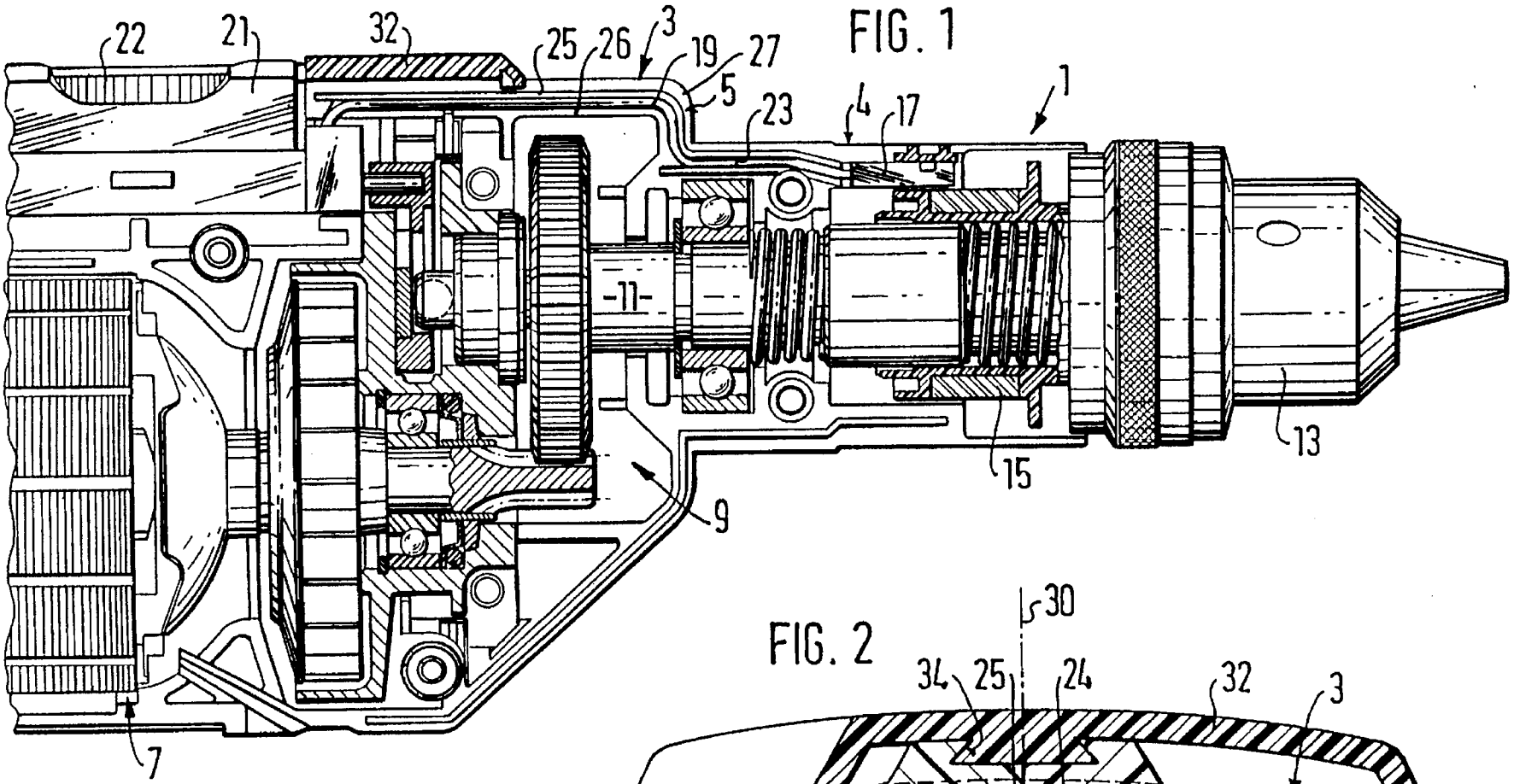
FIG. 1 shows a lateral partial section of a power hand drill and FIG. 2 shows a section through the housing according to the embodiment example in FIG. 1.

The hand-held machine tool shown in section in FIG. 1 is a power hand drill 1 with a housing 3 which is constructed from shell parts and tapers toward a spindle bearing arrangement in the neck 4. The housing 3 has a housing wall 5 and holds a motor 7 and a gear unit 9. The motor 7 is in a working connection with a spindle 11 which carries a drill chuck 13. The spindle 11 also carries a pulse generator constructed as a magnet 15. A sensor 17 is arranged in the housing wall 5 in close proximity to the magnet 15 and is connected via an electric lead 19 with an electronic monitoring and control unit 21 arranged in the motor housing 3 and including an adjusting wheel 22 for regulating the speed or torque. The electric lead 19 is guided in the interior of the housing wall 5, i.e. in a duct 23 constructed as a groove which leads to the neck 4. The duct 23 is recessed into the narrow side of the housing wall 5 of the housing shell part 27 at a dividing plane 30 dividing it from another adjoining housing shell part 29. In addition, a first bead-like rib 25 is formed into the contour of the end face of the housing wall 5 and extends adjacent to the duct 23 similar to a raised embankment.

The two housing shell parts 27, 29 are embraced by an annular sleeve 32 which is held so as to be secured against rotation in a dovetailed groove 34 which is worked into the outer contour of the housing 3 to a roughly identical width on either side of the dividing seam 36 or dividing plane 30.

Figure 2:
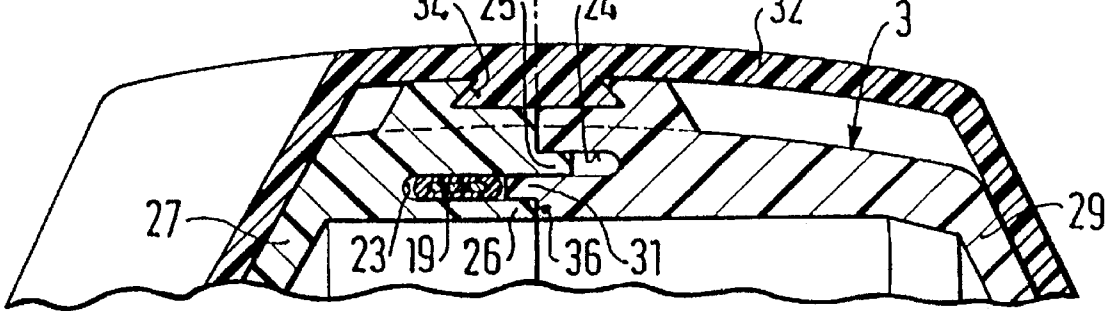

The sectional view of the housing 3 in FIG. 2 shows the housing shell parts 27, 29 in the region of the meandering dividing seam 36. This figure clearly shows that the duct 23 extends between the ribs 25, 26 of the housing shell part 27 and that the electric lead 19 is fixed therein in that it is secured or damped by the third rib 31 of the second housing shell part 29. The ribs 25, 26 of the housing shell part 27 project into recesses or into the duct 24 of the other housing shell part 29 and thus secure the housing shell parts 27, 29 so that they cannot be displaced relative to one another.

It can also be seen that the first rib 25 of the first housing shell part 27 projects into a duct 24 of the housing shell part 29 and that the housing shell halves 27, 29 are accordingly secured in position relative to one another. It can further be seen that the duct 23 has a cross section in the form of an elongated hole and that the electric lead 19 is constructed as a multi-wire flat-ribbon cable.

As a result of the meandering or zigzag shape of the dividing seam 36, the creepage path between the lead 19 and the outer contour of the housing 3 is greater than 4 mm without the need for the housing 3 to be thicker than usual at the dividing seam, so that a wall thickness of roughly 2 mm is entirely sufficient.

FIGS. 1 and 2 show an annular sleeve 32 which holds the two housing shell parts 27, 29 together and forms a reinforcement at a particularly highly loaded point of the housing 3 in which are supported, for example, actuating members for shifting gears or a reversing switch for switching between hammering and drilling.

In an embodiment example of the invention which is not shown in the drawing a bore hole is arranged in the wall of the gear unit housing, which bore hole substantially follows its contour and contains the electric lead cable.

In another embodiment example, not shown, the electric lead cable is permanently sealed inside the housing wall.

In another embodiment example of the invention, not shown in the drawing, a plurality of double-walled housing shell parts are constructed with hollow spaces for receiving cables or the like so that light guides, particularly image-carrying cables, as well as mechanical adjusting means, particularly Bowden cables or switching linkage, can be fixed therein so as to be invisible from the outside.

It will be understood that each of the elements described above, or two or more together, may also find a useful application in other types of constructions differing from the types described above.

While the invention has been illustrated and described as embodied in a powered hand-tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-held machine tool, comprising a housing having a wall provided with a duct; a motor arranged in said housing and having a gear unit with a spindle; a tool holder carried by said spindle; an electric lead extending in said duct of said wall of the housing, said electric lead being fixed in said duct of said wall, said housing including two housing shell parts connected with one another and having a dividing plane, said housing having an outer contour provided with a dovetailed groove; and an annular sleeve which embraces said housing shell parts and is held so as to be fixed with respect to rotation in said dovetailed groove.

2. A hand-held machine tool as defined in claim 1; and further comprising a second such duct, said ducts being arranged at both sides of said dividing plane in said housing shell parts.

3. A hand-held machine tool, comprising a housing, having a wall provided with a duct; a motor arranged in said housing and having a gear unit with a spindle; a tool holder carried by said spindle; and an electric lead extending in said duct of said wall of the housing, said electric lead being tightly arrested in said duct of said wall, said electric lead being a multi-wire cable, said housing including two housing shell parts connected with one another and having a dividing plane, said housing having an outer contour provided with a dovetailed groove; and further comprising an annular sleeve which embraces said housing shell parts and is held so as to be fixed with respect to rotation in said dovetailed groove.

4. A hand-held machine tool, comprising a housing, having a wall provided with a duct; a motor arranged in said housing and having a gear unit with a spindle; a tool holder carried by said spindle; and an electric lead extending in said duct of said wall of the housing, said electric lead being tightly arrested in said duct of said wall, said electric lead being a multi-wire cable, said housing having a neck through which said spindle is guided; means forming a hollow space keeping a sensor arranged at said spindle and sensing a pulse generator, said duct leading to said hollow space, said sensor being a Hall sensor, said housing including at least two walls with a hollow space for receiving cables and the like in a clamping manner, said housing also including two housing shell parts contacting one another at a point of contact provided with a dividing seam which contains said duct, said dividing seam having a contour extending in a meandering manner, and said housing being formed so that a creepage path of at least 4 mm is provided between said electric lead and an outer surface of said housing with a housing wall thickness of less than 4 mm.

* * * * *